US005098160A

United States Patent [19]

Moore et al.

[11] Patent Number: 5,098,160

[45] Date of Patent: Mar. 24, 1992

[54] ERGONOMIC SEATING SYSTEM APPARATUS

[76] Inventors: Susan G. Moore, 3604 County Rd., #2, Swanton, Ohio 43558; James L. Hetherwick, 2336 Beaufort, Toledo, Ohio 43613

[21] Appl. No.: 472,115

[22] Filed: Jan. 30, 1990

[51] Int. Cl.[5] ..... A47C 7/50

[52] U.S. Cl. ..... 297/423; 297/431; 297/174

[58] Field of Search ..... 297/423, 432, 429, 430, 297/431, 344, 174

[56] References Cited

U.S. PATENT DOCUMENTS

| | | | |
|---|---|---|---|
| 576,344 | 2/1897 | Eccleston | 297/431 X |
| 1,173,480 | 2/1916 | Bulik | 297/423 X |
| 1,518,853 | 12/1924 | Kingsley | 297/423 X |
| 1,606,840 | 11/1926 | Koenigkramer | 297/423 X |
| 1,731,375 | 10/1929 | Engers | 297/172 |
| 2,889,869 | 6/1959 | Hoyt et al. | 297/174 |
| 3,130,968 | 4/1964 | De Feen | 297/344 X |
| 4,046,419 | 9/1977 | Schmitt | 297/432 X |
| 4,238,097 | 12/1980 | Clauson et al. | 297/423 X |
| 4,425,863 | 1/1984 | Cutler | 297/423 X |
| 4,913,489 | 4/1990 | Martin | 297/344 X |
| 4,915,450 | 4/1990 | Cooper | 297/423 |

*Primary Examiner*—José V. Chen

*Attorney, Agent, or Firm*—Willian Brinks Olds Hofer Gilson & Lione

[57] ABSTRACT

An ergonomic seating system apparatus includes a linear alignment member, an interconnected seating device, such as a chair, and an adjustable footrest in combination with a work station. Preferably, the work station is fixed. The positions of the footrest and the chair are adjustable along a linear path by motor driven lead screws. The footrest includes a pair of drive motors which independently adjust the height of the front and rear of the footrest thereby facilitating adjustment of both height and inclination. A stanchion receives and retains the chair in the selected linear position. The chair may be removed from the stanchion to permit motion about the work station. Height of the chair is also adjustable. The seating system thus maintains a human body properly positioned fully to the rear in the chair, maintains an angle of between 90 and 180 degrees between the calf and thigh of the operator and maintains the feet at an angle of between about 80 and 130 degrees to the calf, a condition determined to significantly reduce stress and fatigue. A method of positioning a human body in a low fatigue, seated position is also taught.

17 Claims, 4 Drawing Sheets

ERGONOMIC SEATING SYSTEM APPARATUS

BACKGROUND OF THE INVENTION

The invention relates generally to a seating system having a linearly aligned chair, footrest and work station and more specifically to a seating system apparatus having an alignment member wherein the chair, the footrest and the work station are aligned and the chair position and the footrest position as well as the height and inclination of the footrest are adjustable to maintain the torso and limbs of an operator in an optimum low stress, low fatigue position.

Increasing productivity is both an ongoing process and challenge to industry. During the past several decades, attention was directed to improving production by automating repetitious tasks. The use of robotic production equipment represents the current zenith of such an approach. Accordingly, attention has been redirected to other facets of the work environment particularly the work station, through the science of ergonomics which espouses the correspondence between form and function and the logical and coherent relationship between man and machine.

Ergonomic thinking has benefited both the worker and employer and significant improvements in productivity have been achieved through the application of ergonomic principles. An appropriate ergonomic application field relates to sedentary repetitious work tasks wherein a worker may remain seated during an entire shift at a video display terminal (VDT), punch press or similar work station. Repetitious work tasks result in fatigue and physical stress which may lead to physical injury, commonly known as repetitive strain injury or cumulative trauma disorder.

A classic example of non-ergonomic design is the mismatch of desk and chair heights. If chair seat height is not properly adjusted relative to the height of a desk and the size of the operator, the operator may be forced into a kyphotic or rounded back posture which increases neck and back strain or forces the operator to function with his arms in excessive shoulder, adduction or rotation which increases shoulder strain.

Much attention has been paid to the proper positioning and maintenance of the body. The patent literature discloses numerous seating devices of distinct configurations directed to diverse purposes.

For example, U.S. Pat. Nos. 482,745, 488,707 and 491,098 teach barber and dental chairs having integral footrests. The chair disclosed in the first patent is disposed on a movable frame which engages the floor whereas the latter two patents disclose chairs rotatably secured to fixed supports. In the '745 patent the footrest is coupled to the base of a chair configured in a manner similar to a platform rocker. Thus, as the chair cushion moves, the dimensional relationship between it and the footrest changes as well. In the latter two patents, the footrest is an extension of the chair and, accordingly, moves with the chair seat and back maintaining a constant dimensional relationship therebetween.

U.S. Pat. No. 4,348,051 teaches a chair having a mechanism for adjusting its height and a circular footrest surrounding the chair height adjustment mechanism which is coupled to the height adjustment mechanism.

U.S. Pat. No. 3,858,938 discloses a wheelchair having leg and foot supporting means. At the lower forward portion of the chair seat, a pair of L-shaped arms are pivoted to receive and selectively elevate the lower legs. In U.S. Pat. No. 4,538,857, a similar wheelchair construction permits vertical adjustment of the seat height as well as the footrest height and inclination thereof.

Attention has also been paid to footrests as a means of properly positioning the body. For example, U.S. Pat. No. 483,265 teaches a seat and footrest combination. The device disclosed therein includes a pivoted seat board which may be inclined to support the user in a partially erect position or disposed horizontally to provide conventional seating. U.S. Pat. No. 3,653,715 teaches an adjustable footrest wherein the forward and rearward portions of the footrest may be independently adjusted by means of spring biased pivoted legs to provide both height and inclination adjustment.

U.S. Pat. No. 4,427,234 teaches a leg rest having a first support designed to fit under a knee adjacent portion of a person's thighs and a second support designed to receive the feet of a person. The two supports are coupled by a hinged adjustable extension which facilitates storage of the footrest. The foot engaging portion of the footrest is said to be easily pivotable. Another footrest is disclosed in U.S. Pat. No. 4,813,742. Here, a footrest of a size certain has an upper surface oriented at an angle between 9 and 13 degrees. The footstool is intended for relieving strain and preventing orthopedic problems for users engaged in activities such as nursing a baby.

Complex seating configurations have also been developed. U.S. Pat. No. 4,369,997 discloses a sinuous, articulated chair having an elevated seat surface and footrest. The seat surface and the interconnected footrest and backrest may be adjusted from a position in which the seat surface is substantially horizontal and the device functions as a conventional chair to a highly inclined seat surface where the chair functions primarily as a standing rest.

U.S. Pat. No. 4,768,831 teaches a work station or operators seat having a foot control. The seat is adjustable along a fixed inclined axis which rises and recedes from the work station. A footrest is similarly supported along the inclined guide and may be adjusted independently relative to the seat. The feet of the operator are received upon an actuator plate which is pivotally adjustable. The position of the actuator plate controls, for example, the speed of the associated work station equipment. U.S. Pat. No. 4,779,922 discloses another work station wherein a video display terminal or similar device is positioned before an operator seated in a lounge-type chair. The chair is rockable about a horizontal axis adjacent the forward portion of the seating surface. As the seated operator rocks about the horizontal axis, the distance between the operator and the video display terminal and an associated input device remains relatively constant.

While the foregoing seating and support devices address specific task related human seating and support problems, they seldom ensure proper use of the device. That is, basic human nature encourages a person to utilize the seating provided in a personal way. Consequently, a person voluntarily though not consciously may subject himself to unnecessary repetitive physical stress situations because the seating and support equipment has been utilized improperly. It has been found that instruction in proper techniques to prevent such injuries has proven ineffective in spite of the fact that many ergonomic seating designs such as those discussed above have been produced and utilized.

Significant research and design effort has developed desk and chair designs which provide proper support and limb placement in an attempt to limit stresses on the back, neck, shoulder and upper extremity anatomy resulting from prolonged sitting at a work station. In spite of the efforts of designers and manufacturers, however, the operator seldom takes advantage of the intended design and assumes a natural and comfortable though, as noted above, harmful posture. For example, if the back of a chair is designed to support the lumbar region of the back and the operator does not sit back against such lumbar support but sits on the front edge of the chair, the well designed lumbar back support is useless and offers no lumbar support. The benefits of the carefully designed chair are thus lost and what was designed to be a comfortable, low fatigue work station fails to provide the intended performance.

From the foregoing, it is apparent that improvements in the configuration and of combination seating system and work station components is both desirable and beneficial to increase productivity.

SUMMARY OF THE INVENTION

An ergonomic seating system apparatus includes a linear alignment member, an interlinked seating device, such as a chair, and an adjustable footrest in combination with a work station. Preferably, the work station, associated with a desk or bench, is fixed and both the positions of the footrest and the chair are adjustable along a linear path by motor driven lead screws. The chair base is received within an upright stanchion which maintains it in its selected position. The footrest includes a pair of drive motors which independently adjust the height of the front and rear of the footrest thereby facilitate a adjustment of both height and inclination. In an alternate embodiment, an electrically activated yoke device selectively retains the chair in the selected position and releases it as well to permit motion about the work station. The height of the chair is also adjustable. The invention also comprehends manually adjustable components. For example, a less costly version of the system may be produced by providing the adjustment mechanisms with wheels or knobs which may be manually rotated to move the components to desired positions.

The seating system apparatus maintains the operator properly positioned fully to the rear in the chair, maintains an angle of between 90 and 180 degrees between the calf and thigh of the operator and maintains the feet at an angle of between about 80 and 130 degrees to the calf, a condition determined to significantly reduce operator stress and fatigue. A method of positioning the human body in a low fatigue, seated position is also disclosed.

It is thus an object of the present invention to provide an ergonomic seating system apparatus whereby a chair and footrest may be both adjustably positioned along an axis aligned with a work station.

It is a still further object of the present invention to provide a readily adjustable footrest and chair positioning mechanism which may be utilized with conventional chairs and desks.

It is a still further object of the present invention to provide an ergonomic seating system apparatus which, when adjusted to maintain an operator in suitable posture, will remain fixed and maintain the chair and footrest in the desired positions until rearranged.

It is a still further object of the present invention to provide an ergonomic seating system apparatus which may be either manually adjusted or power adjusted by means of, for example, electrical motors.

It is a still further object of the present invention to provide a method of positioning the human body in a low fatigue, seated position.

Further objects and advantages of the present invention will become apparent by reference to the following description to the preferred embodiments and the appended drawings.

DESCRIPTION OF THE PREFERRED EMBODIMENT

Figure 1:
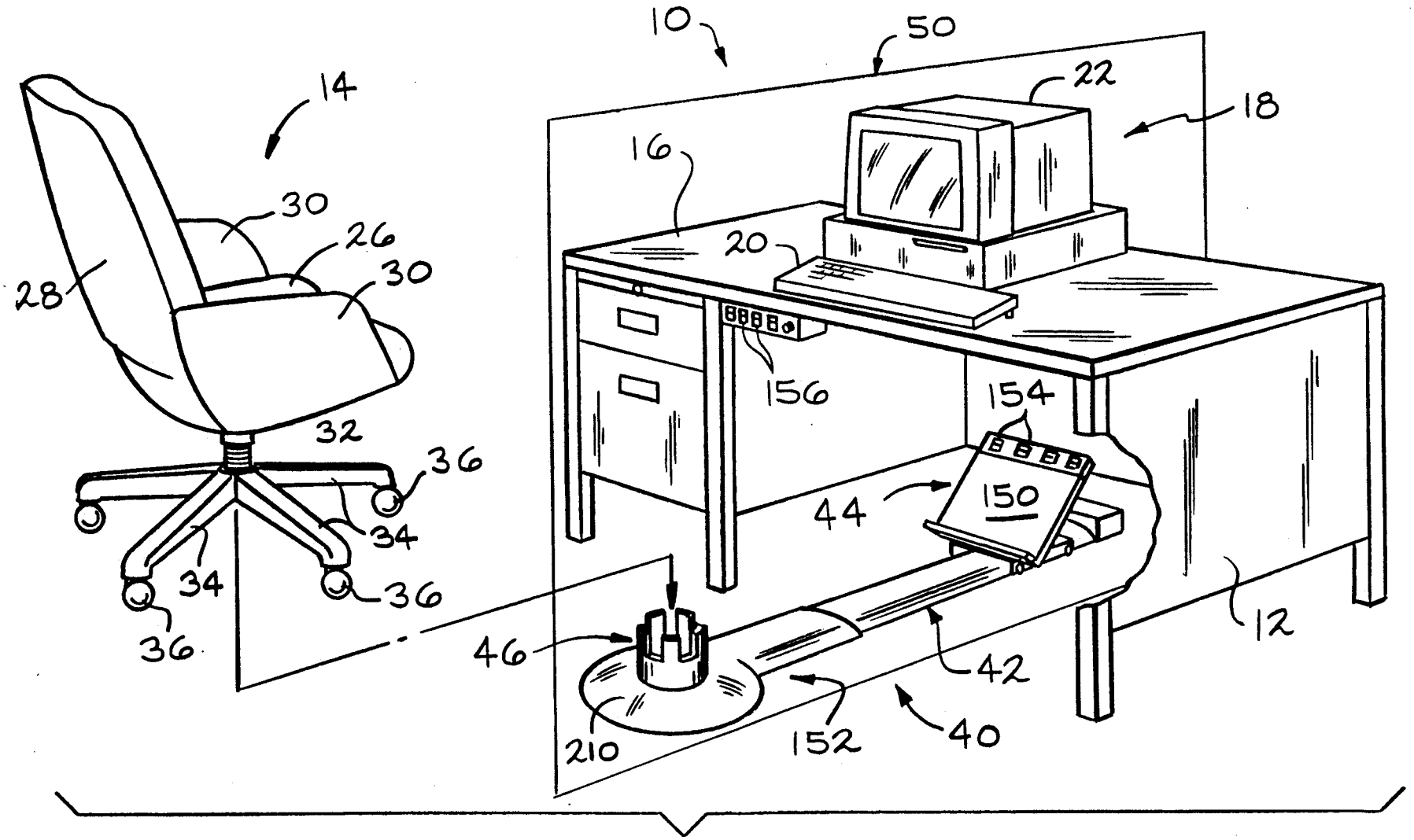
FIG. 1 is a perspective view of an ergonomic seating system apparatus according to the present invention in use with a conventional desk and chair.

Referring now to FIG. 1, an ergonomic seating system apparatus according to the present invention is illustrated and generally designated by the reference numeral 10. The apparatus 10 is utilized in conjunction with a conventional desk 12, bench or similar support and a conventional chair 14. The desk 12 preferably includes a planar surface 16 which may be a work surface or which may include a work station 18 having a keyboard 20 and a CRT (cathode ray tube) display 22 or other machinery such as a drill press, punch press, typewriter, sewing machine or the like.

The chair 14 is preferably substantially conventional and includes a horizontal seating surface 26, a backrest 28 and may include arms or armrests 30. In accordance with conventional practice, the underside of the seat includes an upright column 32 secured to the chair 14 which terminates at its lower extremity in an array of generally radially disposed legs 34. The upright column 32 includes a vertical height adjustment mechanism which facilitates semi-fixed selection of the height of the seating surface 26 and associated components of the chair 14 above the floor in accordance with conventional practice. The legs 34 are preferably terminated by rollers or casters 36 or similar structures which facilitate translation of the chair 14 along a floor both when the chair 14 is occupied and when it is not.

The ergonomic seating system apparatus 10 further includes an alignment assembly 40 defining an elongate telescopic member 42 which receives an adjustable footrest assembly 44 adjacent one end and a chair retaining assembly 46 adjacent the other.

In FIG. 1, there is illustrated a vertical reference plane 50 which bisects the work station 18 and the alignment assembly 40 including the telescopic member 42, the footrest assembly 44 and the chair retaining assembly 46. Accordingly, when positioned within the chair retaining assembly 46, the chair 14 is bisected as well. Although this aspect of the invention will be described in more detail subsequently, it should presently be appreciated that one of the features of the present invention is the alignment and maintenance of such alignment of the chair 14, the work station 18 and the footrest assembly 44 so that a plane such as a vertical reference plane 0 bisects these components.

Referring now to FIGS. 1, 2, 6 and 8, the elongate telescopic member 42 includes a first beam 58 having an upper surface 60 which is preferably convex, arcuate or a similar smooth profile to minimize interference with the feet of an operator. The beam 58 includes a lower planar panel 62 having a width somewhat greater than the beam 58 which defines a pair of parallel ways or tracks 64 adjacent the edges of the beam 58. The tracks 64 receive and support rollers or wheels 66 which are rotatably secured to a base plate 68 of the footrest assembly 44. Alternatively, the wheels or rollers 66 may be discs or tabs of nylon or other similar low friction material which are securely, that is, non-rotatably, affixed to the base plate 68. In either event, the rollers 66 or other devices provide low friction support for and facilitate translation of the footrest assembly 44 and specifically the base plate 68 along the ways or tracks 64 of the beam 58. Secured to the base plate 68 by any suitable means such as rivets, or threaded fasteners is a drive follower 70 having a narrow neck region 72 and an enlarged, lower terminal region 74. The lower terminal region 74 is received and retained within a complementally configured elongate channel 76. It will be appreciated that cooperation between the enlarged lower region 74 and the elongate channel 76 retains the base plate 68 and footrest assembly 44 on the elongate beam 58 while permitting axial motion there along.

Figures 2, 3, 4, 5:
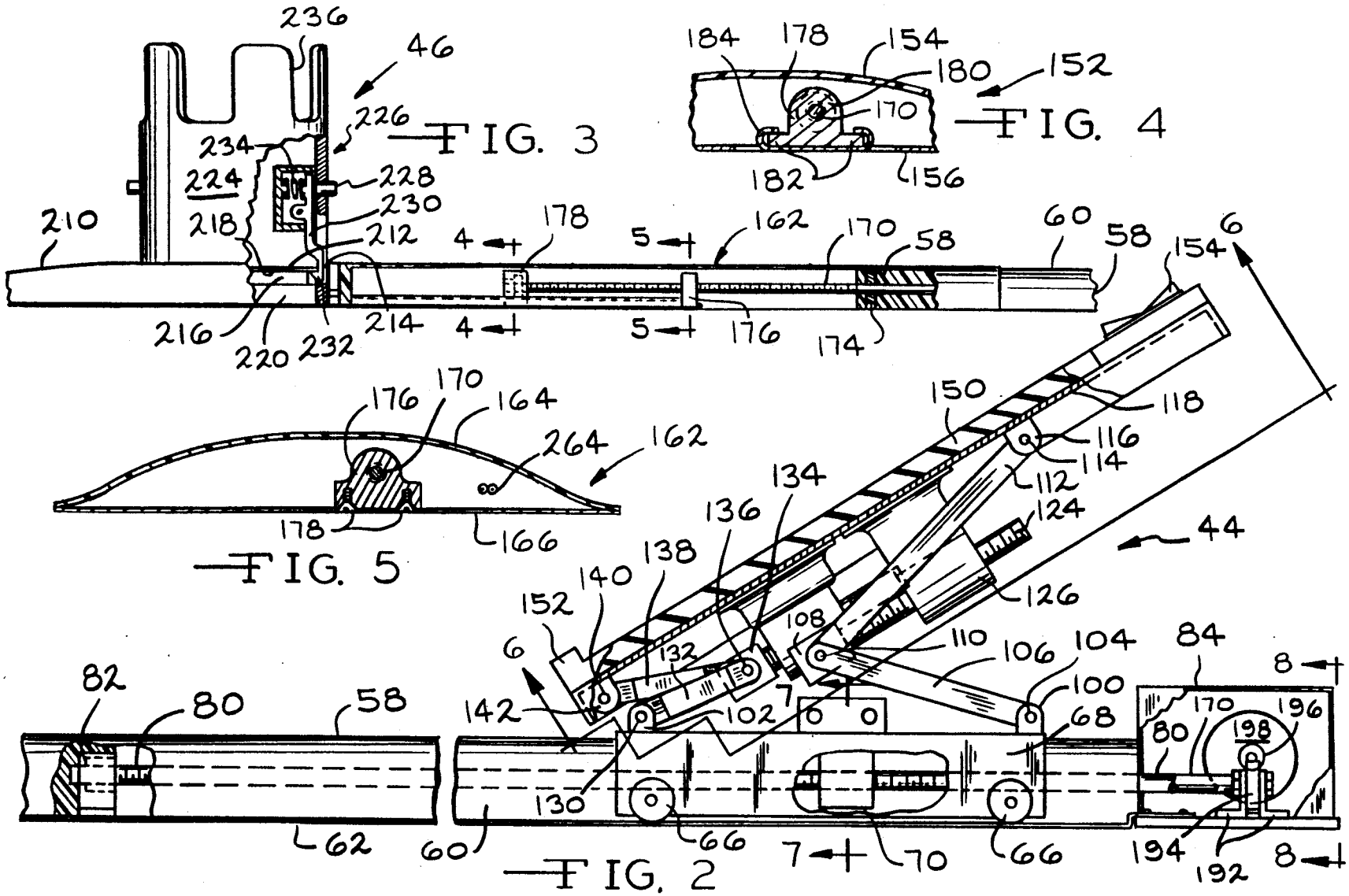
FIG. 2 is a side elevational view in partial section of a footrest and drive assembly according to the present invention.
FIG. 3 is a fragmentary, side elevational view in partial section of the chair receiving stanchion and positioning assembly according to the present invention.
FIG. 4 is a fragmentary, sectional view of a portion of a chair positioning mechanism according to the present invention taken along line 4—4 of FIG. 3.
FIG. 5 is a full, sectional view of a chair positioning mechanism according to the present invention taken along line 5—5 of FIG. 3.
Figure 7:
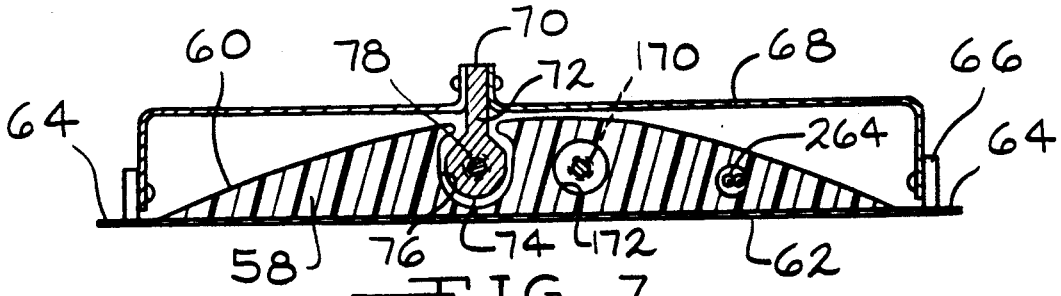
FIG. 7 is a full sectional view of a footrest positioning mechanism according to the present invention taken along the line 7—7 of FIG. 2.
Figure 8:
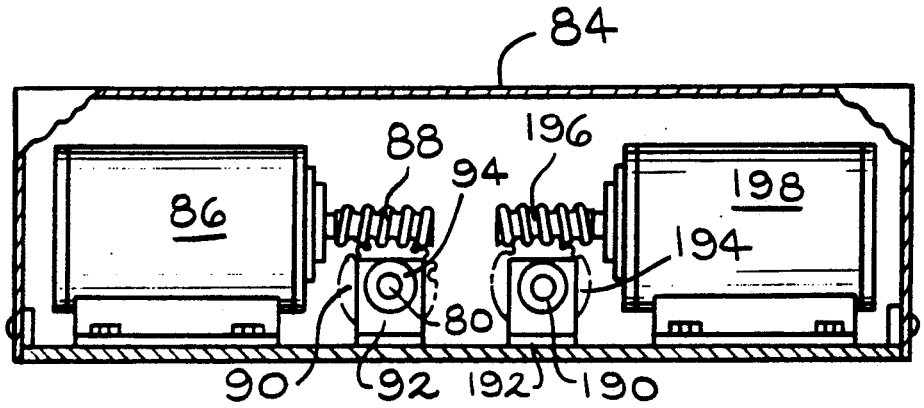
FIG. 8 is a full sectional view of the drive motors of the chair and footrest positioning mechanisms according to the present invention taken along line 8—8 of FIG. 2.

Referring now to FIGS. 2, 7 and 8, the enlarged lower terminal region 74 define a through threaded aperture 78 which receives a complementally threaded lead screw 80. The lead screw 80 extends axially along the elongate passageway 76 and is supported at one end by a bushing 82 and is restrained therein against axial motion by a cotter pin, C-washer or other suitable means. The bushing 82 may be either a journal type or anti-friction type including ball or roller bearings. The end of the lead screw 80 opposite the bushing 82 extends beyond the elongate beam 58 and into a rectangular housing 84. The housing 84 receives and protects a pair of drive motors. A first drive motor 86 is a fractional horsepower, bi-directional motor having its output supplied to a worm gear 88. The end of the lead screw 80 extending into the housing 84 is terminated by a pinion gear 90 disposed within a pair of brackets which support a bushing 94. The bushing 94 may either be a journal type bushing or anti-friction type having ball or roller bearings. When the drive motor 86 is energized and rotates in a first direction, the lead screw 80 will likewise rotate in a first direction driving the base plate 68 and the footrest assembly 44 in a first direction along the beam 58. Conversely, when the drive motor 86 is energized and rotates in the opposite direction, the lead screw 80 will rotate oppositely, causing the base plate 68 and the footrest assembly 44 to translate along the beam 58 in the opposite direction. Since the drive for the footrest assembly 44 includes the lead screw 80, the threaded drive follower 70, the worm gear 88 and the pinion gear 90, the footrest assembly 44 will effectively be fixed against further motion when the drive motor 86 is de-energized as these components will not allow back driven motion.

Figure 6:
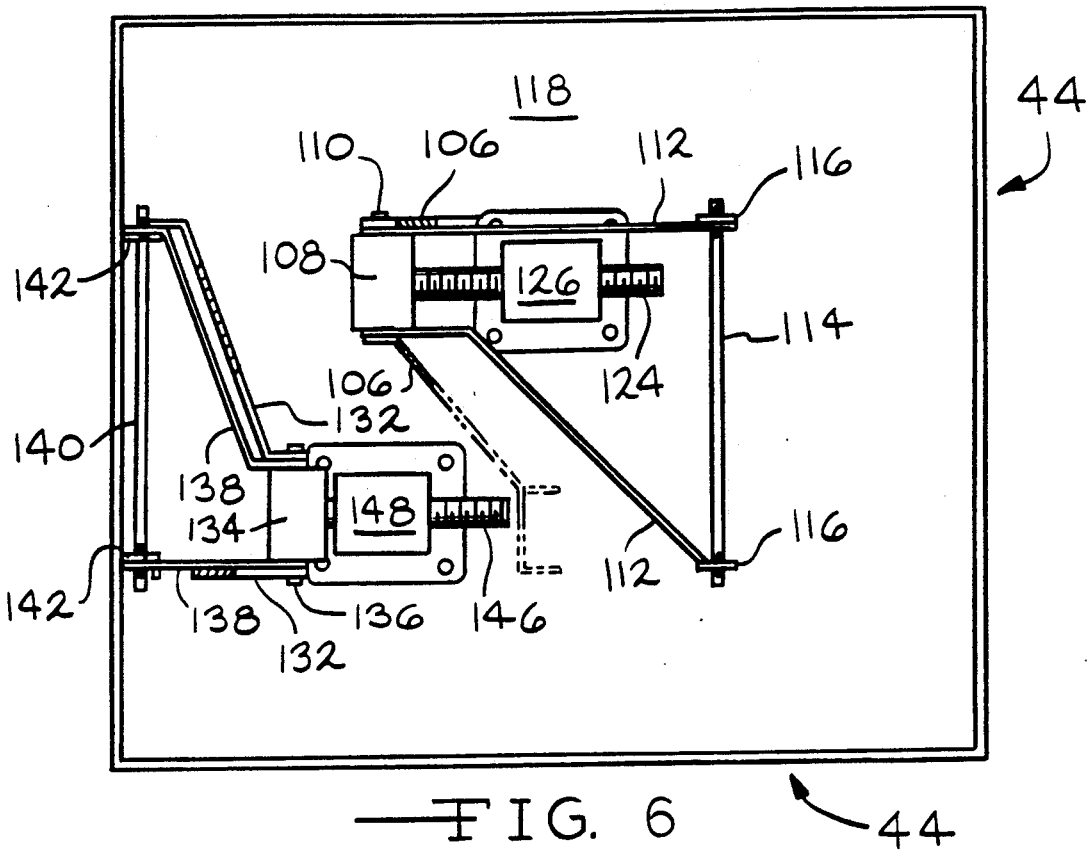
FIG. 6 is an elevational view of the back side of the footrest according to the present invention taken along line 6—6 of FIG. 2.

Turning now to FIGS. 2 and 6, the footrest assembly 44, and specifically the base plate 68, includes a first pair of spaced apart, upstanding tabs or ears 100 at one end of the base plate 68 and a second pair of spaced apart upstanding tabs or ears 102 at the opposite end of the base plate 68. Only one of each pair of the ears 100 and 102 is illustrated in FIG. 2, the second of each pair being disposed directly behind those illustrated. The first pair of tabs or ears 100 receive a pivot pin 104 which, in turn, pivotally receives and secures a first pair of pivot arms 106. The opposite ends of the first pair of pivot arms 106 are pivotally secured to a coupling block 108 by a pair of suitable pivot pins 110. Also pivotally secured to the coupling block 108 by the pivot pins 110 is a second pair of pivot arms 112. The opposite ends of the second pair of pivot arms 112 receive a pivot pin 114 which also extends through and is received within a third pair of spaced apart tabs or ears 116 secured to or extending from the underside of a footrest plate 118. Extending generally medially from the coupling block 108 is a threaded lead screw 124. The threaded lead screw 124 is received within and acted upon by a threaded drive collar (not illustrated) disposed within and driven by a bi-directional, fractional horsepower drive motor 126. Rotation of the drive motor 126 in a first direction translates the coupling block 108 toward the drive motor 126 raising the right end of the footrest plate 118 as viewed in FIG. 2 and rotation of the drive motor 126 in the opposite direction lowers this same region of the footrest plate 118 as will be readily appreciated. Because the drive collar cannot be back driven, once the drive motor 126 has been de-energized, the position of the upper end of the footrest plate 118 is effectively fixed.

The second pair of tabs or ears 102 pivotally receive a pivot pin 130 which, in turn, pivotally receives and secures a third pair of pivot arms 132. The opposite ends of the first pair of pivot arms are pivotally secured to a second coupling block 134 by a pair of suitable pivot pins 136. Also pivotally secured to the coupling block 134 by the pivot pins 136 is a fourth pair of pivot arms 138. The opposite ends of the fourth pair of pivot arms 138 receive a pivot pin 140 which also extends through and is received with a fourth pair of spaced apart tabs or ears 142 secured to the underside of a footrest plate 118. Extending generally medially from the coupling block 134 is a second threaded lead screw 146. The second threaded lead screw 146 is received within and acted upon by a threaded drive collar (not illustrated) disposed within and driven by a another bi-directional, fractional horsepower drive motor 148. Rotation of the drive motor 148 in a first direction translates the coupling block 134 toward the drive motor 148 lowering the left end of the footrest plate 118 and rotation of the drive motor 148 in the opposite direction raising this same region of the footrest plate 118 as will be readily appreciated. Because the threaded drive collar cannot be back driven, once the drive motor 148 has been de-energized the position of the lower end of the footrest plate 118 is effectively fixed.

While the pivot arms 106, 112, 132 and 138 are utilized in pairs and provide a certain range of vertical adjustment, additional pairs of pivot arms may be arranged in a pantograph configuration to provide extended vertical translation, if desired.

As illustrated in FIGS. 1 and 2, the footrest assembly 44 also includes a mat 150 fabricated of rubber or similar slightly resilient, elastomeric material. The mat 150 is secured to and is substantially coextensive with the footrest plate 118. The mat 150 includes a lip 152 at its lower extremity which assists retention of an operator's feet thereon. A plurality of momentary contact switches 154 are disposed across the top of the mat 150 of the footrest assembly 44 and control the motion of the components of the seating system apparatus 10 as will be more fully described subsequently. For convenience purposes, the switches 154 may be duplicated by a second plurality of switches 156 mounted at a conveniently accessible location of the desk 12. The switches 154 and 156 are connected to a source of electrical power and the various drive motors by suitable wiring (not illustrated).

Referring now to FIGS. 1, 3, 7, and 8, the alignment assembly 40 includes the chair retaining assembly 46 at its terminal portion most distant the desk 12. The chair retaining assembly 46 includes an elongate hollow shell 162 having an upper convex or arcuate portion 164 intended to provide minimum interference with the feet of the operator and a planar bottom panel 166. The hollow shell 162 slidingly and telescopically receives a portion of the elongate beam 58. A second lead screw 170 extends axially along the beam 58 in a passageway 172. Generally adjacent the end of the beam 58, there is positioned a bushing 174 which rotatably receives and stabilizes the lead screw 170. The bushing 174 may be either a journal type bushing or an anti-friction bearing such as a ball or roller bearing.

As illustrated in FIG. 5, the lead screw 170 is received within a complementally threaded aperture of a follower block 176 secured to the planar base 166 by threaded fasteners 178 or other suitable fastening means.

As illustrated in FIG. 4, the terminal portion of the lead screw 170 is received and axially retained within a pillow block 178. The pillow block 178 may include either a journal bearing 180 or an anti-friction bearing such as a ball or roller bearing. The end of the lead screw 170 is axially retained within the pillow block 178 by a cotter pin, C-washers or other suitable means. The pillow block 178 includes a pair of opposed ears 182 which are slidably received within a track 184 which may be conveniently formed from upturned portions of the planar bottom panel 166. Alternatively, inverted, L-shaped guides may be utilized to form a track which receives the ears 182 of the pillow block 178.

Referring now to FIGS. 2 and 8, at the terminus of the lead screw 170 opposite the pillow block 178, the lead screw 170 extends into the rectangular housing 84. The terminus of the lead screw 170 is received within a bearing 190 such as a journal bearing or anti-friction bearing which is supported by a pair of brackets 192. A drive pinion 194 is received between the brackets 192 and is driven by a worm gear 196 powered by a fractional horsepower, bi-directional drive motor 198. It will thus be appreciated that rotation of the drive motor 198 in a first direction rotates the lead screw 170 and translates the chair retaining assembly 46 along the axis of the elongate member 42 in a first direction, for example, toward the footrest assembly 44 and that rotation of the drive motor 198 in the opposite direction rotates the lead screw 170 oppositely and translates the chair retaining assembly 46 in the opposite direction, away from the footrest assembly 44. Since the drive for the chair retaining assembly 46 includes the lead screw 170, the threaded follower block 176, the worm gear 196 and the pinion gear 194, the chair retaining assembly 46 will effectively be fixed against further motion when the drive motor 198 is de-energized as these components will not allow back driven motion.

Referring now to FIGS. 1 and 3, the chair retaining assembly 46 includes a convex base 210 which merges with the upper convex portion 164 of the elongate hollow shell 162. The chair retaining assembly 46 includes a circular disc 212 which is generally flush with the upper surface of the base 210. An annular space 214 surrounds the circular disc 212 and communicates with a circumferential, radially inwardly directed re-entrant groove 216. The re-entrant groove 216 is continuous about the circular disc 212 and defines a lip 218. The circular disc 212 is preferably coupled to or formed integrally with a shallow plug 220 which is secured to the lower panel 166 by any suitable means.

A hollow, cylindrical chair receiving and retaining stanchion 224 is received within the annular space 214 and retained there by a pair of retaining mechanisms 226 one of which is illustrated in FIG. 3. The retaining mechanisms 226 each include a radially oriented button 228 which may be manually depressed against a pivoted lever 230 having a latch member 232. A compression spring 234 biases the lever 230 toward the pin 228. When the pin 228 is depressed, lever 230 and specifically the latch 232 moves radially outwardly permitting insertion or withdrawal of the retaining stanchion 224 into the base 210. It will be appreciated that removal of the cylindrical member 224 is only possible with depression of the buttons 228 but that if the latch member 232 is properly positioned and configured that is, with a obliquely tapering lower portion which engages the edge of the circular disc 212, as the stanchion 224 is forced downwardly, the latch members 232 will be forced radially outwardly permitting insertion of the stanchion 224 into the chair retaining assembly 46.

The cylindrical stanchion 224 also includes a plurality of uniformly circumferentially arranged deep slots 236 which receive the legs 34 of the chair 14. Accordingly, it will be understood that the present invention comprehends the use of one of a selection of cylindrical stanchions 224 which match both vertically and numerically the position and arrangement of the legs 34 of the chair 14 utilized with the system apparatus 10 of the present invention. That is, stanchions 224 having four, five or six deep slots 236 may be provided as may stanchion 224 of varying heights or inside diameters. It will be appreciated that the purpose of such variation is to receive and retain the upright column 32 of a wide variety of chairs 14 thus making the present invention adaptable for use with such wide variety of chairs.

Figure 9:
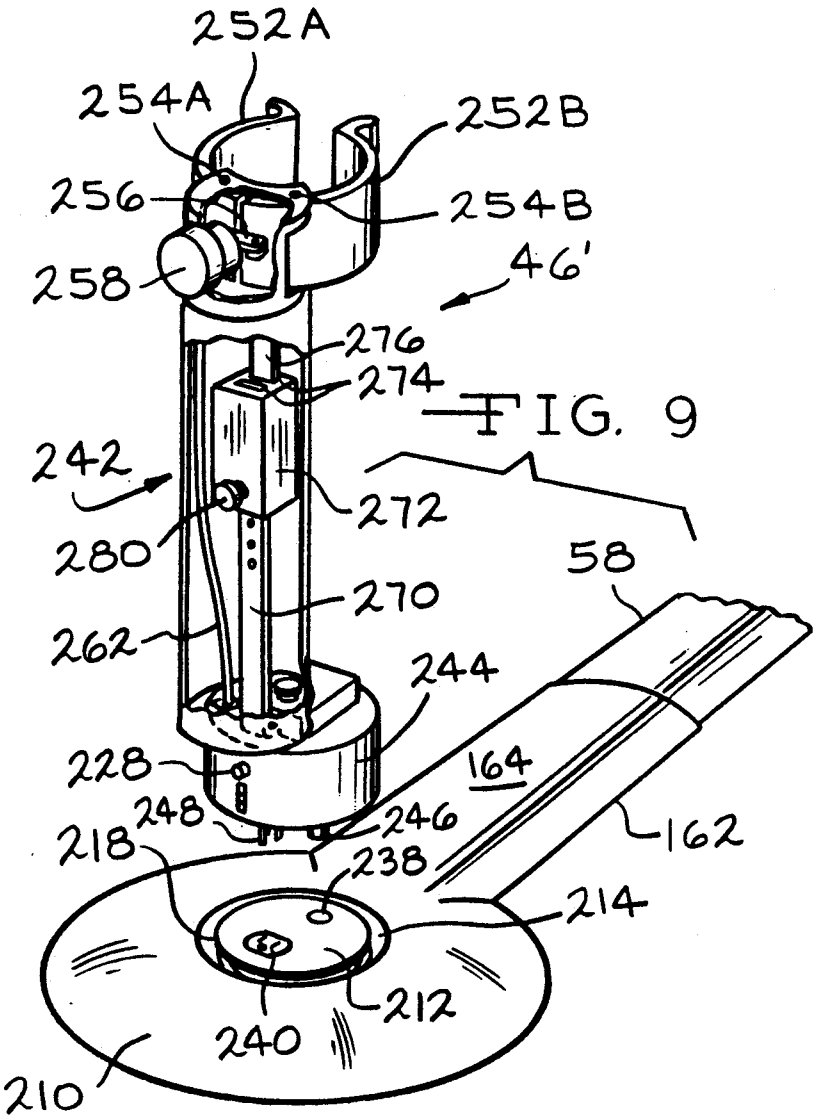
FIG. 9 is a fragmentary, perspective view of an alternate embodiment chair receiving yoke according to the present invention.

Referring now to FIGS. 1, 3 and 9, an alternate embodiment chair retaining assembly 46' is illustrated. The alternate embodiment chair retaining assembly 46' includes the base 210 as well as the radially extending convex portion 164 which forms a portion of the shell 162. Likewise, the alternate embodiment assembly 46' includes the disc 212 surrounded by the annular space 214. The disc defines the lip 218. Disposed in the upper face of the disc 212 is a blind aperture 238 and an electrical socket 240. The alternate embodiment chair retaining assembly 46' includes an upright stanchion 242 having a lower hollow, cylindrical base 244 which is complementary to and received within the space 214. Projecting from the lower, cylindrical base 244 is a register pin 246 which is received within the blind aperture 238 to inhibit rotation of the stanchion 242 and an electrical plug 248 which mates with the electrical socket 240 as will be readily appreciated. At its upper extremity, the stanchion 242 includes a pair of opposed, spaced apart yoke members 252A and 252B. The yoke members 252A and 252B are pivoted about axes defined by pivot pins 254A and 254B. The plunger 256 of a solenoid 258 or similar electrical operator engages portions of the yoke members 252A and 252B opening them when activated so that the upright column 32 of a chair 14 may be received therewithin. A two conductor electrical cable 262 couples the solenoid 258 with the plug 248 and a two conductor electrical cable 264 (illustrated in FIGS. 5 and 7) couples the electrical socket 240 with one of the switches 154 on the footrest assembly 44 or one of the switches 156 on the desk 12.

The height of the yoke members 252A and 252B is adjustable so that they will receive the upright column 32 of a given chair 14. Such adjustment is accomplished by means of the upright bar 270 which extends vertically from the cylindrical base 244. A block 272 having a pair of parallel, through slots 274 receives the bar 270 and a second bar 276 which extends upwardly and supports the yoke members 252A and 252B and associated components. A threaded thumb screw 280 selectively engages the upright bar 270. When the thumb screw 280 is tight, the components of the alternate embodiment chair retaining assembly 46' remain in their desired vertical positions and when the thumb screw 280 is loosened, they may be adjusted vertically as will be readily appreciated.

While the seating system apparatus 10 described above has included electrically driven motors 86, 126, 148 and 198 controlled by the switches 154 and 156, it should be understood that a simplified and less costly version of the apparatus may be fabricated by replacing the electrical components with manually driven handwheels, knobs, locks and similar operator driven devices which adjust or permit adjustment of the various movable components of the system apparatus 10.

Figure 10:
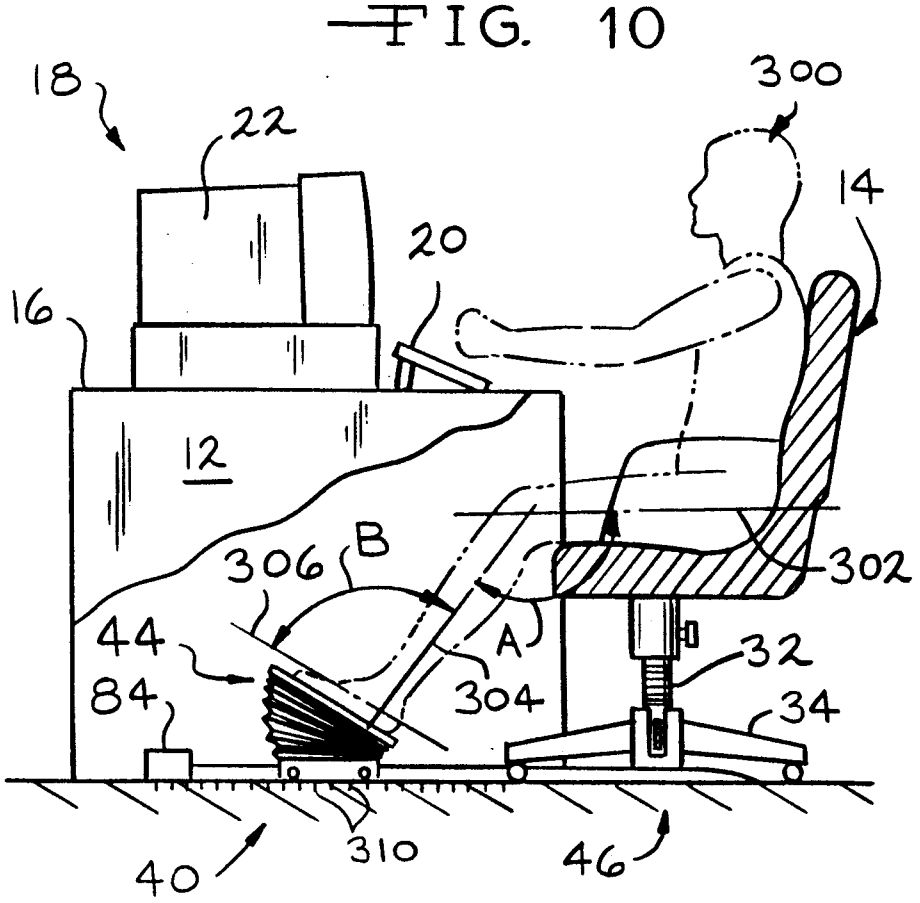
FIG. 10 is a diagrammatic, side elevational view of the present invention in use at a work station.

The operation of the ergonomic seating system apparatus 10 will now be described with particular reference to drawing FIGS. 1, 2, 3 and 10. As illustrated in FIG. 10, the operator 300, illustrated in phantom lines, is seated in the chair 14 before a work station 18 disposed upon a desk 12, bench or similar support. The body of the operator 300 includes upper leg portions, i.e., thighs, which are disposed along lines of action 302, lower leg portions, i.e., calves, which are disposed along lines of action 304 and feet which are disposed along lines of action 306. The lines of action 302 and 304 define an angle A and the lines of action 304 and 306 define an angle B.

The operator 300 is illustrated in an appropriate low fatigue seating position provided by the seating system apparatus 10. More importantly, the seating position is maintained by the positions of the chair 14 and the footrest assembly 44 relative to one another and also relative to the desk 12 and work station 18. This seating position and the maintenance of the seating position is achieved by the retention of the vertical column 32 of the chair 14 in the chair retaining assembly 46 and the motion of the footrest 44 along the elongate member 42. The alignment assembly 40 is positioned relative to the work station 18 such that the vertical reference plane 50 bisects not only the work station 18, the footrest assembly 44 and the alignment member 40 but also the chair 14 when disposed in the cylindrical stanchion 224 or the upright stanchion 242.

The alignment assembly 40 may be secured to a carpeted floor by a plurality of pins 310, or to other surfaces by an adhesive layer, threaded fasteners or any other suitable means. For purposes of explanation, it will be assumed that the desk 12 is fixed and that the position of the work station 18 is preferably fixed as well. Accordingly and alternatively, the alignment assembly 40 may be secured to the desk 12.

It should be understood that these assumptions are made because the purpose of the invention is to place and retain an operator 300 in a low fatigue seated position by controlling the relative positions of the chair 14, the footrest assembly 44 and the work station 18. Since this necessary relative positioning may be accomplished through adjustability of only two of these three components, for obvious practical reasons, the desk 12 and work station 18 have been selected as the fixed components. As used herein, "fixed" is a relative term meaning not readily adjustable. Obviously, the desk 12 may be moved, if desired or necessary, to, for example, facilitate initial alignment of or adjust the alignment of the work station 18 with the alignment member 40. Furthermore, should situations require it, it is anticipated that components of the work station 18 may be adjustable, that is, capable of movement toward or away from the operator 300 while maintaining a position that is bisected by the vertical reference plane 50.

The position of the chair receiving stanchions 224 or 242 is first adjusted by activating the fractional horsepower, bi-directional drive motor 198 to translate the chair 14 into an appropriate position whereby the arms and particularly the hands of the operator 300 are comfortably disposed at the work site such as the keyboard 20. The height of the chair 14 may also be adjusted at this time to facilitate a relaxed arm posture and an angle of less than 180 degrees at the elbow.

Next, the footrest assembly 44 is translated along the alignment member 40 by activation of the fractional horsepower, bi-directional drive motor 86 to position the footrest assembly roughly under the foot of the operator as illustrated in FIG. 10. Proper positioning of the footrest assembly 44 will result in an angle A between the lines of action of the thigh 302 and of the lower leg 304 of between about 90 and 180 degrees. Preferably, angle A will be between 100 and 150 degrees.

Lastly, the bi-directional motors 126 and 148 are activated to raise and lower the front and rear portions of the footrest mat 150 as well as raise the entire mat 150 if necessary or desired. The angle B between the line of action of the lower leg portion 304 and the line of action of the foot 306 is between about 80 and 130 degrees and is preferably between about 100 and 115 degrees.

Accordingly, the present invention not only provides an optimum ergonomically designed and configured seating system, but the invention also ensures through maintenance of relative positions of the components as well as their alignment that an operator 300 will properly utilize them, thereby enjoying the benefits of the system apparatus 10 and minimizing job related stress and fatigue.

The foregoing disclosure is the best mode devised by the inventors for practicing this invention. It is apparent, however, that apparatus incorporating modifications and variations will be obvious to one skilled in the art of seating equipment. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. An ergonomic seating system apparatus comprising, in combination, an elongate member for disposal on a floor having a pair of opposed ends and defining an axis, a footrest assembly having a foot receiving panel, said footrest assembly coupled to said elongate member and disposed for translation along said axis adjacent one of said ends, a chair engaging fixture coupled to said elongate member adjacent the other of said ends and having means for engaging a portion of a chair structure, drive means for selectively, bi-directionally translating said footrest assembly along said axis of said elongate member, drive means for selectively, bi-directionally adjusting the height and inclination of said foot receiving panel above said floor, and drive means for selectively, bi-directionally translating said chair engaging fixture along said axis of said elongate member.

2. The ergonomic seating system apparatus of claim 1 further include a work station and a fixed work station support whereby said work station, said elongate member, said footrest and said chair are bisected by a vertical reference plane.

3. The ergonomic seating system apparatus of claim 1 wherein said elongate member includes a pair of lead screws, a first of said pair of lead screws coupled to said footrest through a follower and a second of said pair of lead screws coupled to said chair receiving fixture through a follower.

4. The ergonomic seating system apparatus of claim 1 wherein said footrest includes at least a first pair of arms having ends coupled to a drive mechanism for selectively raising and lowering one end of said footrest and at least a second pair of arms having ends coupled to a second drive mechanism for raising and lowering the opposite end of said footrest.

5. The ergonomic seating system apparatus of claim 1 wherein said footrest includes a plurality of momentary contact switches for controlling said drive means.

6. The ergonomic seating system apparatus of claim 1 wherein one of said ends of said elongate member is secured to said floor and the other of said ends of said elongate member is movable and includes said chair receiving fixture.

7. The ergonomic seating system apparatus of claim 1 wherein said footrest includes a base plate having a plurality of low friction members engaging tracks adjacent one of said pair of ends of said elongate member.

8. The ergonomic seating system apparatus of claim 1 wherein said chair engaging means is a hollow cylinder having at least four axially extending slots opening at one end.

9. An ergonomic seating system apparatus for use with a work station comprising, in combination, an elongate member for disposal on a floor having a fixed portion and a movable portion, said elongate member defining an axis, a footrest having a foot receiving panel and disposed for translation along said axis on said fixed portion of said elongate member, a chair receiving fixture coupled to said movable end of said elongate member and defining at least one means for receiving a portion of said chair, and drive means for selectively, bi-directionally translating said footrest along said fixed portion of said elongate member, drive means for selectively, bi-directionally adjusting the height and inclination of said foot receiving panel, and drive means for selectively, bi-directionally translating said movable end of said elongate member and said chair receiving fixture along said axis.

10. The ergonomic seating system apparatus of claim 9 wherein said elongate member includes a pair of lead screws, a first of said pair of lead screws driven through a worm gear and coupled to said footrest and a second of said pair of lead screws driven by a worm gear and coupled to said chair receiving fixture.

11. The ergonomic seating system apparatus of claim 9 wherein said footrest include a first set of pantograph arms having ends coupled to a drive mechanism for selectively raising and lowering one end of said footrest and a second pair of pantograph arms having ends coupled to a second drive mechanism for raising and lowering the opposite end of said footrest.

12. The ergonomic seating system apparatus of claim 9 wherein said footrest includes a base plate having a plurality of low friction members engaging tracks adjacent one of said pair of ends of said elongate member.

13. The ergonomic seating system apparatus of claim 9 wherein said chair receiving fixture is a hollow cylinder having at least four axially extending slots opening at one end.

14. An ergonomic seating system apparatus comprising, in combination, an elongate alignment member for disposition on a floor, said member defining an axis, a footrest assembly coupled to said alignment member and disposed for translation therealong, said footrest including a foot receiving pad and means for adjusting the height and inclination of said foot receiving pad, said just recited means including first drive means for adjusting the height of the heel end of said foot receiving pad and second drive means for adjusting the height of the toe end of said foot receiving pad, means coupled to said alignment member for receiving and retaining a portion of a chair, drive means for selectively, bi-directionally adjusting the positions of said footrest assembly and chair receiving means along said axis.

15. The ergonomic seating system apparatus of claim 14 further including a work station and means for adjusting the positions of said footrest assembly and said chair receiving means relative to said work station.

16. The ergonomic seating system apparatus of claim 14 wherein said footrest assembly include a first set of pantograph arms having ends coupled to a drive mechanism for selectively raising and lowering one end of said footrest assembly and a second pair of pantograph arms having ends coupled to a second drive mechanism for raising and lowering the opposite end of said footrest.

17. The ergonomic seating system apparatus of claim 14 further including a work station and a fixed work station support whereby said work station, said elongate member, said footrest and said chair are bisected by a vertical reference plane.

* * * * *